US006685056B1

(12) United States Patent
Argentieri et al.

(10) Patent No.: US 6,685,056 B1
(45) Date of Patent: Feb. 3, 2004

(54) DISPENSING DEVICE COMPRISING A RESERVOIR AND ATTACHMENT MEANS PROVIDED WITH PROTECTED PIERCING MEANS

(75) Inventors: Andrea Argentieri, Brussels (BE); Yvon Crozet, Brussels (BE); John Russell Lawson, Cincinnati, OH (US); Patrizio Ricci, Grimbergen (BE); Jelle Dankert Vuijk, Rome (IT)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 10/048,890

(22) PCT Filed: Jul. 28, 2000

(86) PCT No.: PCT/US00/20592

§ 371 (c)(1),
(2), (4) Date: May 8, 2002

(87) PCT Pub. No.: WO01/10768

PCT Pub. Date: Feb. 15, 2001

Related U.S. Application Data

(63) Continuation of application No. 09/577,416, filed on May 22, 2000, now Pat. No. 6,386,392.

(30) Foreign Application Priority Data

| | | |
|---|---|---|
| Aug. 5, 1999 | (EP) | 99870169 |
| Dec. 1, 1999 | (EP) | 99870246 |
| May 31, 2000 | (EP) | 00870116 |

(51) Int. Cl.[7] ..... B67D 5/02

(52) U.S. Cl. ..... 222/83.5; 222/86; 222/325; 222/465.1; 222/530; 239/309

(58) Field of Search ..... 222/81, 82, 83, 222/83.5, 85, 86, 88, 325, 465.1, 527, 529, 530; 239/309; 137/68.29, 68.3

(56) References Cited

U.S. PATENT DOCUMENTS

| | | | |
|---|---|---|---|
| 3,092,106 | A | 6/1963 | Butler |
| 3,131,712 | A | 5/1964 | Risley |
| 3,200,994 | A | 8/1965 | Levinson |

(List continued on next page.)

FOREIGN PATENT DOCUMENTS

| | | |
|---|---|---|
| CA | 2007887 | 7/1990 |
| CA | 2008148 | 7/1990 |
| CA | 2075473 | 8/1991 |
| CA | 2091020 | 10/1993 |
| CA | 2157597 | 9/1994 |
| CA | 2133238 | 4/1995 |
| EP | 0 369 722 B1 | 5/1990 |
| GB | 2 264 702 | 9/1993 |
| GB | 2 339 772 | 2/2000 |
| LU | 54072 | 12/1967 |
| WO | WO 83/00932 | 3/1983 |

*Primary Examiner*—Gene Mancene
*Assistant Examiner*—Eric Keasel
(74) *Attorney, Agent, or Firm*—Thibault Fayette; Kim William Zerby; Steven W. Miller

(57) ABSTRACT

The present invention is directed to a device comprising an appliance, and a reservoir suitable for being removably connected to said appliance, said appliance comprising at least one piercing means and said reservoir comprising one pierceable means, said appliance comprising a releasable protecting means for preventing access to said piercing means when said reservoir is not connected to said appliance. The present invention is further directed to said appliance, and also to said reservoir. In a preferred embodiment of the invention, the appliance comprises an actuation trigger to release said protecting means and give access to said piercing means, and said reservoir comprises a releasing means to cooperate with said actuation trigger in releasing said protecting means. Also preferably, said appliance and said reservoir are provided with cooperating securing means, so as to ensure that said reservoir is secured into said appliance, ones connected thereinto.

8 Claims, 4 Drawing Sheets

U.S. PATENT DOCUMENTS

| | | | | | |
|---|---|---|---|---|---|
| 3,542,240 | A | | 11/1970 | Solowey | |
| 3,685,694 | A | | 8/1972 | Ianelli | |
| 3,788,519 | A | * | 1/1974 | Mengel | 222/83.5 |
| 3,828,973 | A | | 8/1974 | Birrel | |
| 3,926,339 | A | | 12/1975 | Openchowski | |
| 3,952,918 | A | | 4/1976 | Poitras | |
| 3,953,902 | A | | 5/1976 | Taylor | |
| 3,995,772 | A | | 12/1976 | Liautaud | |
| 4,081,006 | A | | 3/1978 | Crowell et al. | |
| 4,173,295 | A | | 11/1979 | Steinmann | |
| 4,177,828 | A | * | 12/1979 | Vache | 222/83.5 X |
| 4,189,068 | A | * | 2/1980 | Apellaniz | 222/83.5 |
| 4,699,188 | A | | 10/1987 | Baker | |
| 5,020,220 | A | | 6/1991 | Miyake | |
| 5,086,950 | A | | 2/1992 | Crossdale | |
| 5,104,003 | A | | 4/1992 | Stecoza | |
| 5,118,009 | A | | 6/1992 | Novitsky | |
| 5,273,186 | A | * | 12/1993 | Widmer | 222/82 X |
| 5,425,528 | A | | 6/1995 | Rains | |
| 5,435,462 | A | | 7/1995 | Fujii | |
| 5,487,728 | A | | 1/1996 | Vaillancourt | |
| 5,732,853 | A | | 3/1998 | Ganzeboom | |
| 5,827,486 | A | | 10/1998 | Crossdale | |
| 5,875,921 | A | | 3/1999 | Osgar | |
| 5,896,898 | A | | 4/1999 | Crossdale | |
| D424,167 | S | | 5/2000 | Yuen | |
| 6,095,370 | A | | 8/2000 | Rhine | |
| 6,109,480 | A | | 8/2000 | Monsrud | |
| 6,152,327 | A | | 11/2000 | Rhine | |
| 6,321,941 | B1 | | 11/2001 | Argentieri et al. | |
| 6,386,392 | B1 | | 5/2002 | Argentieri et al. | |
| 6,390,335 | B1 | | 5/2002 | Lawson et al. | |

* cited by examiner

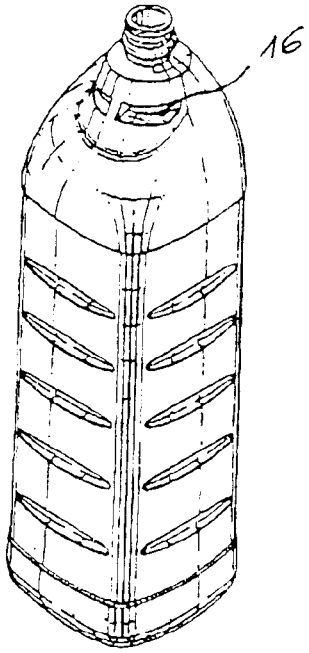
Fig. 2.A
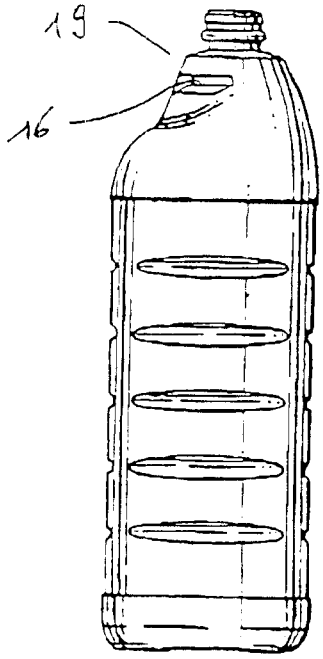
Fig. 2.B
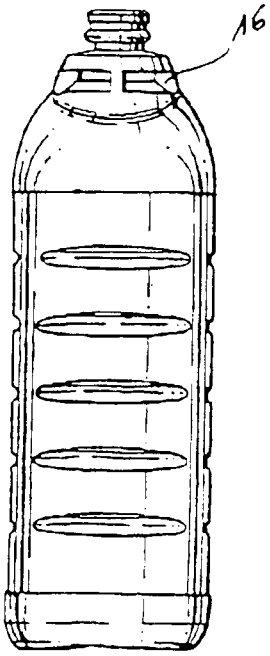
Fig. 2.C
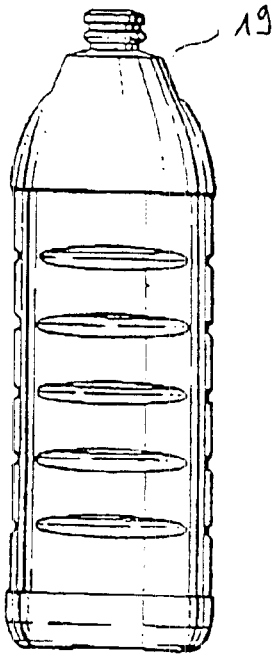
Fig. 2.D
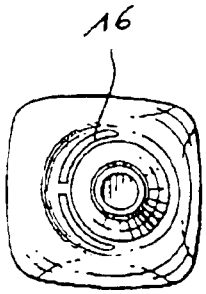
Fig. 2.E
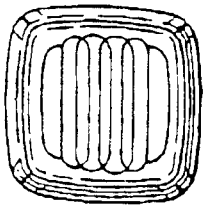
Fig. 2.F

DISPENSING DEVICE COMPRISING A RESERVOIR AND ATTACHMENT MEANS PROVIDED WITH PROTECTED PIERCING MEANS

This is a continuation of application Ser. No. 09/577,416, filed May 22, 2000, now U.S. Pat. No. 6,386,392.

FIELD OF THE INVENTION

The present invention relates to a liquid dispensing device comprising a liquid dispensing appliance and a reservoir to be fitted thereinto.

BACKGROUND OF THE INVENTION

Spray devices are known for the purposes of domestic cleaning, for example for cleaning hard surfaces such as windows, baths and ovens, as well as for spot cleaning of floor coverings such as carpets. Most spray devices which are commercially available are manually or electrically operated, that is to say that the devices comprise a pump which is activated or operated by the consumer. Most commonly this activation generates liquid pressure in a chamber by means of a positive deplacement pump by means of a positive deplacement pump which in turn drives the liquid from the chamber usually through a dispensing nozzle. Many dispensing patterns are possible, but a conical spray is the most common. Usually, such spray devices comprise a reservoir filled with an active composition, and a means to dispense the composition from within said reservoir. The spray devices typically further comprise a basic fitment system to secure the reservoir onto the dispensing means, so as to establish a fluid communication between the two.

Some of these fitment systems comprise a needle that connects the dispensing means and the reservoir in a leak tight-manner, through a pierceable member.

The following references are directed to devices comprising a reservoir and a dispensing means which are fitted to each other by means by a needle/pierceable member:

D1 (U.S. Pat. No. 5,389,085) is a US patent to International Medical Consultants, Inc. It discloses an automatic needle protector, especially for use with a syringe. The needle protector comprises a cylinder slidably mounted via a spring onto the syringe. In normal position, the spring pushes the cylinder, which surrounds the needle. When a vertical pressure is applied onto the cylinder, and the cylinder slides down, giving access to the needle.

D2 (U.S. Pat. No. 5,486,163) is a US patent to Haynes Miller, Inc. It discloses a shield for protecting the needle of a syringe, with an annular connector for connecting the two, and comprising at least one protective arm hingedly mounted upon the connector and pivotable between a first protecting position, and a second open position.

After removing the reservoir from the appliance, the needle is accessible by anyone who would put his hand into the appliance's recess. Such needles are typically very sharp, and likely to cause injury upon contact, more particularly if some dispensed product remains on it. This is the case for any type of user, but especially in the case of children. Indeed, it has been shown that children are very curious and while playing, they tend to put their hands into the recess of the dispensing appliance.

Therefore, such appliances should comprise a protecting means that is locked in a position to prevent access to the needles, unless a reservoir suitable for use with said appliance is inserted thereinto. Thus there is a need for a reservoir suitable for use with a dispensing appliance, said dispensing appliance comprising a piercing means to pierce a pierceable means of said reservoir so as to establish a fluid communication between said reservoir and said appliance, said appliance further comprising a protecting means releasably locked in a position so as to prevent access to said piercing means, said reservoir comprising means to unlock said protecting means when said reservoir is inserted into said appliance.

SUMMARY OF THE INVENTION

The present invention is directed to a device comprising an appliance, and a reservoir suitable for being removably connected to said appliance, said appliance comprising at least one piercing means and said reservoir comprising one pierceable means, said appliance comprising a releasable protecting means for preventing access to said piercing means when said reservoir is not connected to said appliance. The present invention is further directed to said appliance, and also to said reservoir.

In a preferred embodiment of the invention, the appliance comprises an actuation trigger to release said protecting means and give access to said piercing means, and said reservoir comprises a releasing means to cooperate with said actuation trigger in releasing said protecting means. Also preferably, said appliance and said reservoir are provided with cooperating securing means, so as to ensure that said reservoir is secured into said appliance, once connected thereinto.

BRIEF DESCRIPTION OF THE DRAWINGS

The invention will now be explained in detail with reference to the accompanying drawings, in which:

FIGS. 2A to 2F showing different views of a reservoir according to the present invention.

DETAILED DESCRIPTION OF THE INVENTION

Generalities

Figure 1A:
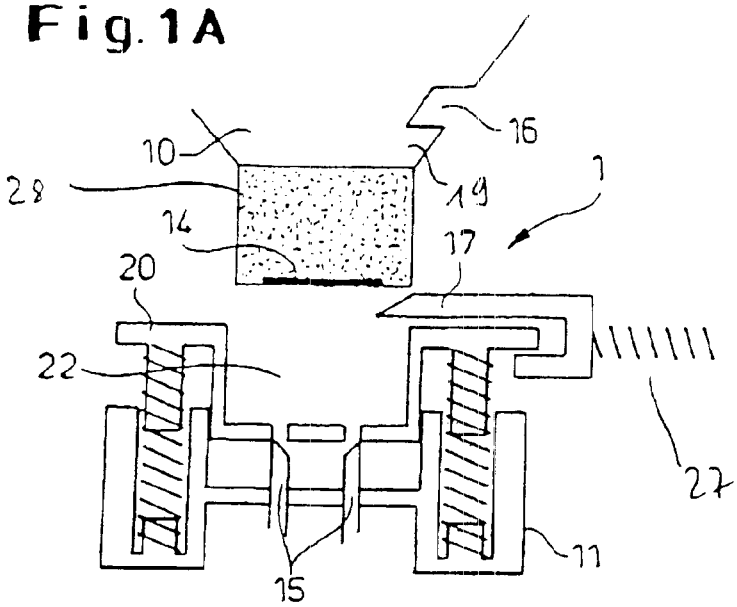
FIGS. 1A to 1C are schematic profile cut views showing one embodiment of the fitment means, with the reservoir respectively disconnected, partially connected and fully connected to the appliance.

In the context of the present invention a device (1) is provided for dispensing a product onto a surface, preferably a cleaning product, more preferably a cleaning product for treating carpets or other large fabric coverings. Said device (1) comprises the combination of a reservoir (10) for containing a composition, preferably a liquid cleaning product, with an appliance for dispensing the product. Any type of device comprising a dispensing appliance and a reservoir can use a fitment as hereafter described, in order to establish a fluid communication between said reservoir and said dispensing appliance. However, in the rest of the present description, and for clarity purposes, one embodiment of a dispensing appliance (11) is described in more detail, which preferably comprises a housing, a spraying arm (12), and a means for conducting product from the reservoir (10) to the spraying arm.

Preferably, the dispensing appliance (11) comprises a manually or electrically driven pump. More preferably, said dispensing appliance (11) comprises an electrically driven pump which is used to pump product from the reservoir (10) through the spraying arm and out of the product dispensing opening (or openings) located in the spraying arm, to the surface to be treated. In this way, the dispensing appliance (11) connected to a reservoir (10) constitutes an electrical spraying device (1), as shown for example in FIG. 5. The product dispensing openings are preferably nozzles which are selected so that the sprayed product takes the form of a continuous stream or film, or of a discontinuous stream or film of fine particles, or of a mist, or of a foam. It is most preferred that the spray pattern is in the form of fine particles because this is the most efficient way to cover a large surface area with a small volume of product with an even coverage. Typically the product output is from about 20 ml/minute to about 400 ml/minute, and preferably from about 150 ml/minute to about 250 ml/minute, the product being typically suitable for carpet cleaning. Devices which can use a fitment according to the present invention are for example devices for spraying household cleaning or laundry products, or perfumes. In a preferred embodiment, such devices are used for dispensing a cleaning solution for cleaning surfaces such as fabrics, carpets, floors, and ceilings.

It is preferred that the spray arm (12) has one nozzle (13), but it may also have multiple nozzles located along its length. The spray arm (12) makes it easier to control where the cleaning product is sprayed. For example, when cleaning carpets the spray arm (12) makes it easier to avoid spraying product onto furniture and walls, and also enables access into corners which would otherwise be difficult to reach. Furthermore, an ergonomically designed spray arm (12) avoids the need for the user to have a bent back when spraying. The spray arm (12) is preferably extendible and/or detachable from the dispensing means housing.

In a particularly preferred embodiment, the means for conducting the product from the reservoir (10) through the spray arm (12) to the product dispensing opening comprises an electrically driven pump. The electrically driven pump may be, for example, a gear pump, an impeller pump, a piston pump, a screw pump, a peristaltic pump, a diaphragm pump, or any other miniature pump. In one embodiment the pump is a gear pump with a typical speed between 6000 and 12000 rpm.

The electrically driven pump must be driven by a means such as an electric motor. The electric motor typically produces a torque between 1 and 50 mN.m. The electric motor must, in turn be provided with a power source. The power source may be either mains electricity (optionally via transformer), or it may be a throw-away battery, or rechargeable battery. Most preferred are one or more AA rechargeable or disposable batteries, the batteries being housed in the package. The voltage output of the battery is typically between 1.5 and 12 Volts, with a preferred output between 3 and 6V.

In one embodiment, the pump is designed to be reversible, so that it can dispense liquid from the reservoir (10), and suck liquid from a surface, or only from the pipes of the dispensing appliance (11), back into the same or preferably another reservoir (10). Typically, only small amounts of liquid can be sucked back from a surface, and such a reversible pump is not intended to replace the use of a vacuum cleaner. Several ways of inverting the rotation of the pump can be used. In one example, the pump and motor are linked to a timer and an electronic circuit, such that after a defined time (e.g. 15 seconds) the motor is not used, it automatically starts again, and its rotation side is reversed. As a result, the remaining product in the tubing and the extension of the dispensing appliance (11) is sucked back into the reservoir (10). As a consequence when replacing a product by another one, it is easy to change the product without mixing new and old products. For example, the consumer can use the dispensing appliance (11) for dispensing a first type of composition, then wait for the pump to suck back said first composition from the pipes, and then change the reservoir (10) or its contents to dispense a second composition without mixing of the two compositions inside the pipes.

The device (1) is preferably hand-held, and therefore preferably comprises a holding means, which is more preferably integrated to the housing of the dispensing appliance (11). The holding means may be any sort of handle (18) which will allow the user to pick up the device (1) and to carry it to the place where the spraying is to be carried out. The handle (18) can be part of the reservoir (10) or of the housing of the dispensing appliance (11). It is likely that the device (1) will be carried around a whole room when a carpet is being cleaned, and/or will be manipulated in all directions during use. The handle (18) may be a simple protrusion or indentation which may be gripped by the user, or it may be a more sophisticated design for ergonomic reasons.

In one alternative embodiment, the housing of the dispensing appliance (11) to be used in the context of the present invention comprises a means allowing the user to carry it without using hands. In a first example, the housing comprises a clip which allows the user to hang said housing to a belt. In another example, the housing comprises at least one shoulder strap which allows to carry said housing on the shoulder/back. Other such means may be applied which allow the user to use both hands for other tasks.

At least one reservoir (10) is provided, that is suitable for being removably connected to said appliance (11), and which can be of any type capable of containing a product under liquid form—by liquid it is meant to include embodiments when the product comprises a solid and a solvent for progressively dissolving said solid. Also included are liquids comprising small particles in suspension.

Said reservoir comprises a longitudinal axis, through the top and bottom end walls of said reservoir. For clarity purposes, the top end of the reservoir is defined as the end comprising the dispensing opening of said reservoir.

Said reservoir (10) is preferably located into the housing of the dispensing appliance (11), and can be made out of any suitable material, such as metal, alloy, glass, but is preferably made out of plastic. It comprises at least one compartment comprising at least one composition. Also preferably, the reservoir is vented. This means that the reservoir (10) comprises a means for connection to the dispensing appliance (11), such that it provides fluid connection between the two and allows fluid to exit said reservoir into said dispensing appliance (11), but it also allows simultaneous admission of air back into the reservoir (10) to compensate the loss of contents. Such a vented reservoir is clearly necessary, especially in case the reservoir is rigid and its contents is pumped by an electrical pump in a continuous manner and/or is used over a long period without stopping the dispensing of contained product. Indeed, while the contents is being removed from the reservoir, the same volume of gas or air needs to be replaced, otherwise, a depression is created which stops the pump after a while. Some alternative solutions could be envisaged, such as for example a reservoir made of two portions, one rigid outer shell combined with a flexible collapsible inner pouch, or a flexible pouch, with at leat one rigid portion, for example the spout. In such a system, the inner pouch would progressively collapse during dispensing of the product, thus avoiding the need for replacement of the dispensed contents by a gas, and thus avoiding the need for a venting system. However, it has been found that such alternative systems are technically difficult to manufacture, and are expensive.

The reservoir (10) is fitted to the dispensing appliance (11) by means of at least one piercing means (15) of the appliance—for example at least one needle (15)—which punctures at least one pierceable means (14) of the reservoir. Preferably, said at least one needle (15) is located into a recess of the appliance, into which said reservoir (10) is normally placed during use, and said pierceable means (14) is located onto the reservoir (10).

In a preferred embodiment, the dispensing means comprises two needles: one is for dispensing of liquid from the reservoir, the other one is for admission of air back into said reservoir, so as to ensure that the loss of contents in said reservoir is compensated. Such a connection system ensures that the reservoir is correctly vented, thus ensuring proper continuous pumping and dispensing of its contents. But alternatively, the venting of the reservoir can be achieved by a one-way valve, or by a venting membrane.

The at least one reservoir (10) can be fixed into the housing of the dispensing appliance (11), and then, preferably comprises one opening, more preferably a reclosable opening. Alternatively, the at least one reservoir (10) can be removable from the housing of the dispensing appliance (11), so that it is replaceable when empty, or it can be refilled, for example with tap water.

In a first embodiment, the dispensing appliance (11) comprises one reservoir (10) with one compartment, comprising one or more composition(s), preferably one composition.

In a second embodiment, the dispensing appliance (11) comprises one reservoir (10) with at least two different compartments, each of which can comprise different compositions, for example non-miscible compositions or two chemically reacting solutions which react once mixed. Such a reservoir (10) is made for example by an extrusion blowing process.

In a third embodiment, the dispensing appliance (11) comprises at least two separate reservoirs. These reservoirs can have different shapes, for example they can be designed with complementary shapes. Alternatively, different reservoirs can be plugged into the dispensing appliance (11) at different locations. Said reservoirs can comprise one or more compartments comprising same, but most preferably different products.

In a fourth embodiment, the dispensing appliance (11) comprises at least one portion for connecting a resevoir (10) comprising a liquid such as a solvent or water, and at least one additional portion for connecting a small cartridge of a concentrated composition, for example under liquid, gel or granulated form. At the time the consumer uses the dispensing appliance (11), the composition contained into the cartridge will be dissolved into the solvent or water, and the resultant active liquid composition will be dispensed through the spray nozzle (13). Alternatively, said cartridge is connected directly into one portion of a reservoir (10). The cartridge can be for example screwed into an appropriate opening of the housing, or of the resevoir (10). It comprises a seal portion, such that when fully screwed, it sealably closes said appropriate opening.

In all of the preceding embodiments, when the dispensing appliance (11) comprises more than one reservoir (10), the proportion of product pumped can differ from one reservoir (10) to another. For example, this is achieved by selecting pipes of different diameters for a reservoir (10) and another, or by adding a flow-control means to the pipes between one reservoir (10) and the pump.

In another embodiment, a kit is also provided which comprises the dispensing appliance (11) and at least one reservoir (10) comprising a product. Preferably, the kit comprises the dispensing appliance (11) and a set of several removable reservoirs, each comprising a different product. The different products can be products for treating different areas such as carpets, kitchen surfaces, bathroom surfaces, cars or else.

In a particularly preferred embodiment of the present invention, the neck (19) of the reservoir (10) is off-centered in the cross sectional plan of said reservoir (10), relatively to the longitudinal axis of said reservoir (10), and the reservoir (10) is non-cylindrical. This is best shown in FIGS. 2A to 2F. Such a shape prevents the reservoir (10) from moving laterally and/or rotationally into the dispensing means housing, especially during use, thus preventing leakage.

Appliance

Appliance needles:

In one preferred embodiment, the dispensing appliance (11) comprises a means for conducting the product from the reservoir (10) through the spray arm (12), to the product dispensing opening from which said product is dispensed. Said means for conducting the product is connected to the reservoir (10) and to the spray arm (12), for example via pipes, which can be for example flexible plastic pipes, and more importantly, through a fitment system which is hereafter described in more detail. The means for conducting the product from the reservoir (10) to the spray arm (12) is preferably contained into the housing, as well as the pipes, if any.

Figure 1B:
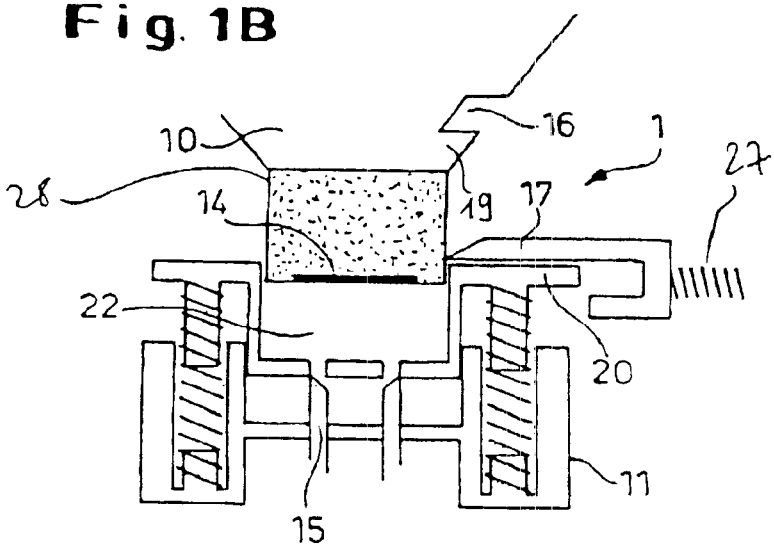
Figure 1C:
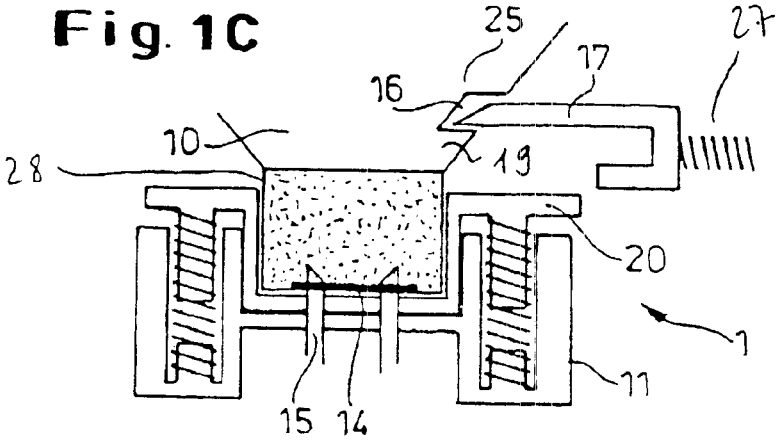
Figure 3:
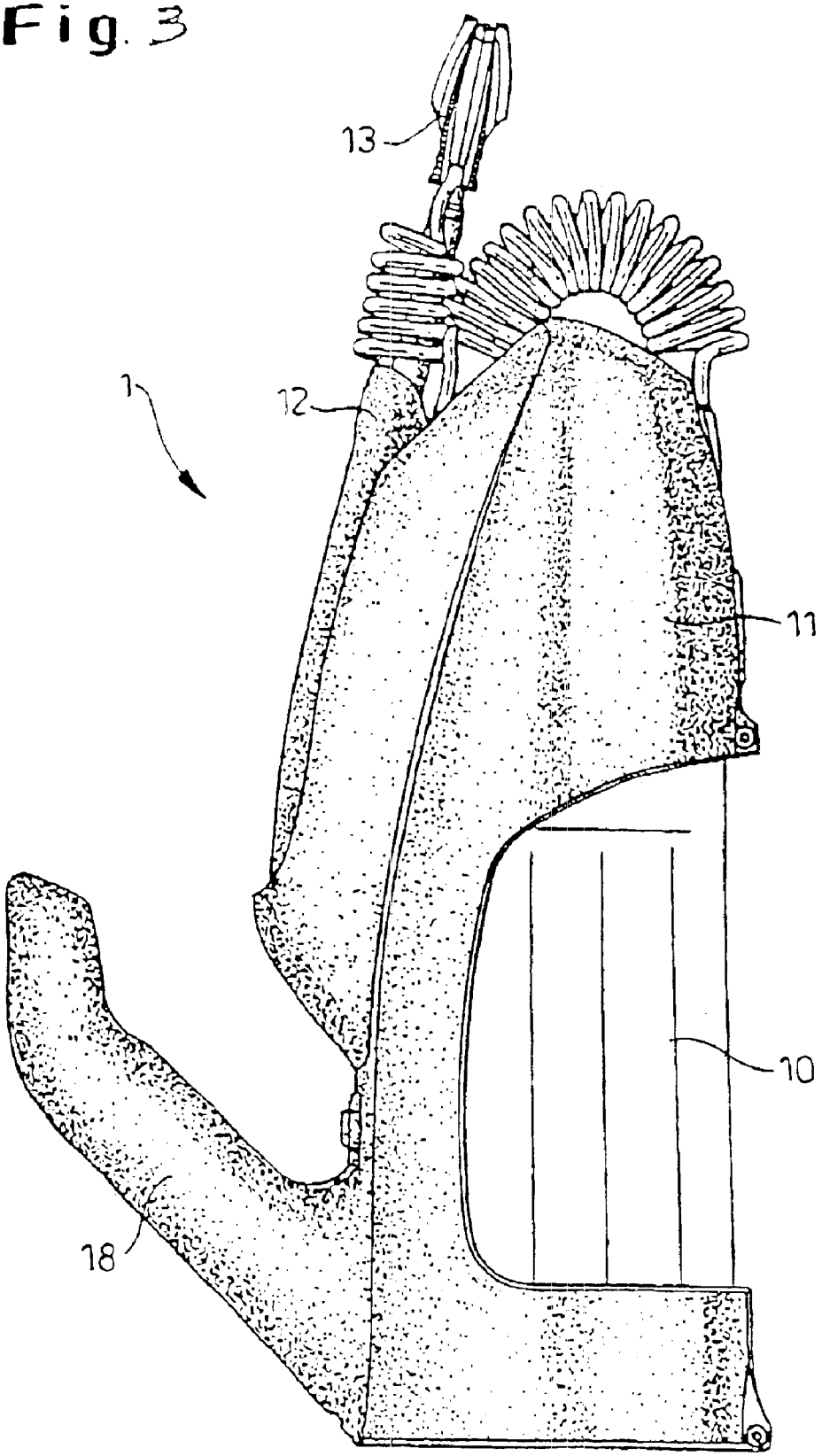
FIG. 3 is a profile view of an appliance with reservoir fitted therein.

As previously described, it is an essential feature of the present invention that the dispensing appliance (11) comprises a piercing means that fits respectively a corresponding pierceable means of the reservoir (10). Preferably, said dispensing appliance comprises a piercing means which fits into a corresponding pierceable means of the reservoir. More preferably, said piercing means of the dispensing appliance is achieved by at least one needle (15), which fits with a pierceable means of the reservoir (10), as shown in FIGS. 1A to 1C. Also more preferably, the pierceable means of the reservoir is integrated to a cap that closes said reservoir. Even more preferably, said pierceable means is an elastomeric membrane (or septum) and the appliance comprises two needles, one being connected to the pumping means, the other one comprising a one-way valve or venting membrane for letting air enter the reservoir (10) while the contents is removed therefrom, thus playing the role of a venting system.

Alternatively, said piercing means is located onto the reservoir, and said pierceable means is located into the appliance. In the rest of the present description, only the preferred embodiment featuring the needle(s) onto the appliance and the pierceable means onto the reservoir will be further discussed, but this should not be taken as a restriction to the scope of the present invention.

At first use, when the consumer inserts the reservoir (10) into the dispensing appliance (11), the elastomeric membrane (14) is pierced, as shown in FIG. 1C, so as to establish a leak-tight fluid communication between the interior of said reservoir (10) and the dispensing appliance (11). Then, the reservoir's contents is pumped through one needle (15), to the pump, up to the spray arm's nozzles, and is dispensed to the surface to treat. This provides a device wherein the operation of plugging/unplugging the reservoir from the housing of the dispensing means in order to establish a fluid, but leak-tight, communication between the two is very easy and obvious to the consumer. It also provides a fitment which is not very complex (needle and elastomeric membrane) and thus quite cheap to produce.

The at least on needle (15) which is used for the present invention may have several shapes or constitutive materials such as stainless steel, tantalum, zirconium . . . etc., but preferably, it is made out of metal stainless steel 304 or similar stainless steel. More preferably it has an outside diameter comprised within the range of 0.7 to 7 mm, and more preferably an outside diameter comprised within the range of 0.7 to 2.5 mm. Also preferably, it has an internal diameter comprised within the range of 0.5 to 2 mm, and even more preferably, an inside diameter comprised within the range of 0.5 to 1.5 mm. In case said at least one needle is a bevel-edged needle, it preferably has a tip angle comprised within the range of 15° to 30°, and even more preferably, said needle (15) has a tip angle of 21°. However, other shapes for a needle can be used.

It has been found that bevel-edged needles may be at least partially obstructed by a portion of the membrane, which may render the appliance non-functional. This is due to the fact that the heel of the needle's bevel is very sharp, and at the time the needle is inserted into the membrane, said sharp heel may poke out a little portion of the membrane, which then slides into the needle's channel, leading to obstruction of said channel. One solution to avoid that problem is to use a non-coring needle, which is defined as a needle that is designed and manufactured such that it cannot poke out a portion of the material wherein said needle is inserted. There are different types of non-coring needles. For example, it can be achieved by sand-blasting the heel of the bevel, so as to erode it, until it loses its sharpness. Alternatively, the needle can be shaped like a pencil tip, with its hole located on a lateral side of the needle, and not on the tip itself, so that no beveled sharp edges can cut and detach a portion of the pierceable material. Alternatively, the needle's tip can be in the shape of a scalpel blade, with the hole located on a lateral side of the needle, not on the blade itself, so that no beveled sharp edge can be cut and detach a portion of the pierceable material. Such non-coring needles are known in the art, and the skilled person may appropriately chose the right shape and size for a needle, to meet the purpose of the present invention.

Appliance protecting plate:

As hereafter described in more detail, it is an essential feature of the appliance to be used in the context of the present invention that the piercing means, i.e. preferably the needles (15) which are mounted onto the appliance (11) are protected from access by a consumer by a protecting means, for example by a spring loaded protecting plate (20) which prevents access to said needles (15) when the appliance contains no reservoir (10), and which frees the access to the needles (15) whenever a reservoir (10) is fully inserted into said appliance (11).

Preferably, as shown in FIGS. 1A to 1C, the protecting means (20) is a movable protecting plate (20). More preferably, said protecting plate (20) comprises a recess (22) in the shape of the reservoir's cap. Said protecting plate (20) is spring loaded, so that it automatically returns to a position in which access to the needles (15) is prevented, whenever the reservoir (10) is removed from the appliance. Any type of spring can be used, but preferably, the springs (27) are helicoidal springs (27), as shown in FIGS. 1A to 1C. At the time the reservoir (10) is inserted into the neck (19) of the appliance, its neck (19) and/or closure push against said protecting plate (20) so that the needles (15) are accessible, and can pierce the pierceable means (14) to establish a fluid communication in a leak-tight manner between said reservoir (10) and said dispensing appliance (11).

Appliance actuation trigger

As already described above, said appliance (11) comprises a protecting plate (20) which prevents access to the appliance piercing means (15) unless said protecting plate (20) is released by inserting the reservoir (10) thereinto. When the reservoir is inserted, it activates a trigger that releases said protecting plate (20), thus giving access to the needles. Said releasing means of the appliance thus acts as an actuation trigger (17).

It is highly beneficial to the present invention, that said actuation trigger (17) also secure the reservoir in the appliance, said trigger is preferably achieved by a slideable ring (17). In this preferred embodiment, when said reservoir (10) is inserted into said appliance (11), said reservoir (11) engages and slides said slideable ring (17), and thus, triggers the protecting plate (20) in released position, thereby exposing the needles (15) to the pierceable membrane (14) of the reservoir (10). Then, upon further insertion of the reservoir (10), the pierceable membrane (14) is pierced, and then the slideable ring (17) engages said recess (16) in said reservoir, thereby securing the reservoir in place in the appliance, now ready for use.

After use, the user pushes the button, disengaging the slideable ring (17) from the recess (16) of the reservoir, so that the reservoir (10) can be disengaged from the appliance (11). When the button is released and the reservoir (10) has been completely disengaged from the appliance (11), the slideable ring (17) returns to its rest position, thereby releasing the protecting plate (20), which prevents access to the needles (15) again. This can be achieved by various mechanical structures, one of them being shown in FIGS. 1A to 1C.

Figure 4:
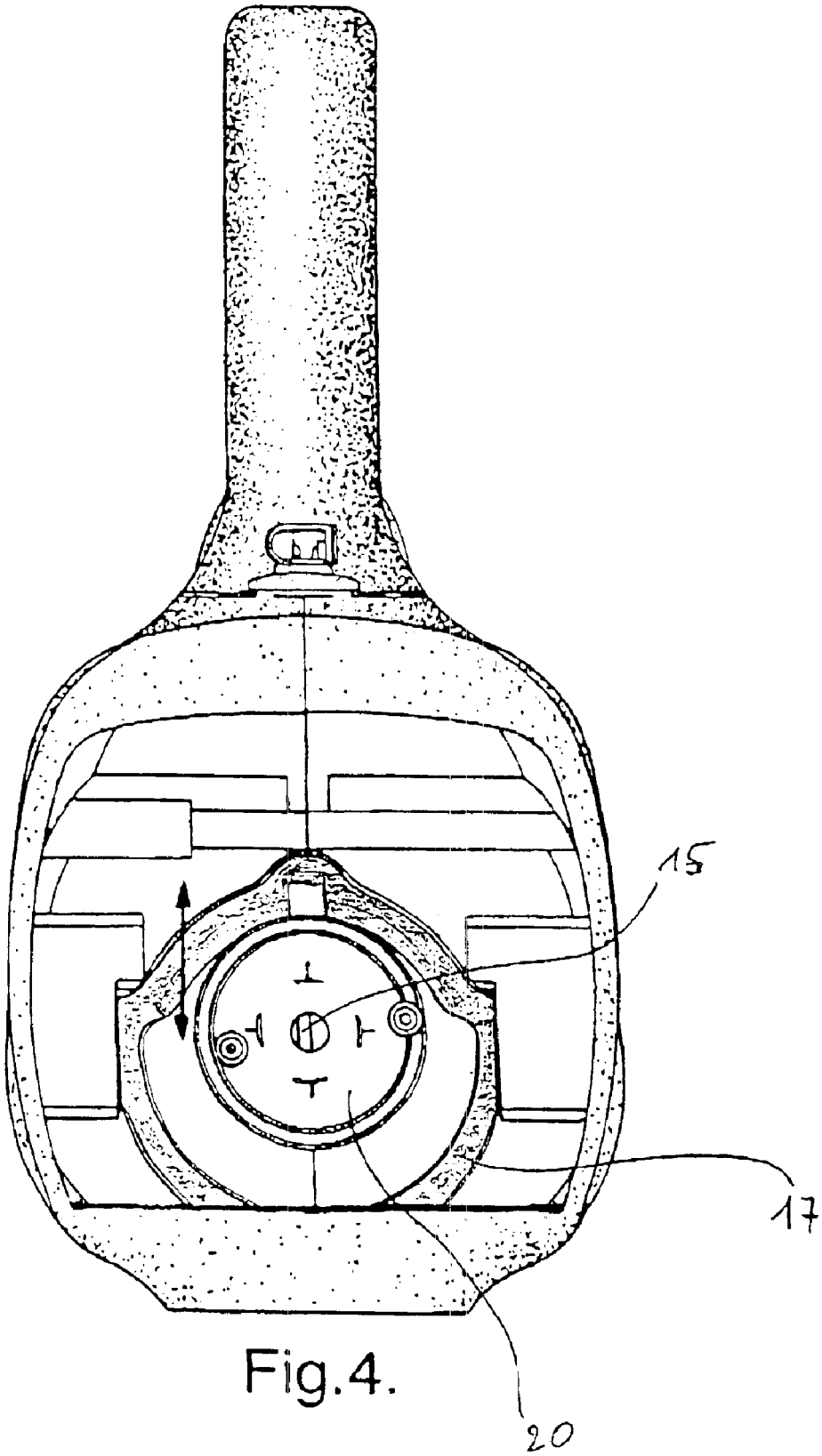
FIG. 4 is a back view showing the interior of the appliance. No reservoir is inserted therein, so the slideable ring—also securing means of the appliance in this embodiment—is visible.

Appliance securing means:

It has been found that if the reservoir is secured (i.e. maintained) tightly inside the appliance, the risk of leakage between the two is reduced, or even eliminated. Therefore, the dispensing appliance (11) to be used in the context of the present invention preferably comprises a securing means (25) to secure said reservoir into said appliance. In a preferred embodiment, said securing means (25) comprises at least one protrusion (17) of the appliance to fit onto at least one corresponding recess (16) of the reservoir, said reservoir (10) being releasably secured in a leak-tight manner into the dispensing appliance (11) such that fluid communication between said reservoir (10) and said means is established, only when said protrusion(s) and recess(es) are fitted into each other, and said recess(es) (16) of said reservoir (10) have complementary shapes of said protrusion (17) of said dispensing appliance (11). Preferably, the dispensing means comprises at least one protrusion that fits into a corresponding and complementary recess of the reservoir, as shown in FIGS. 1A to 1C. More preferably, said protrusion (17) of the appliance is achieved by a slideable ring (17), that is slidably mounted into the housing of said appliance, as shown in FIG. 4. While said reservoir is inserted into said appliance, one portion of said reservoir located above said recess (16) of said reservoir, first pushes against said slideable ring (17), and then, as the user continues to insert said reservoir into said appliance, said slideable ring (17) faces said recess (16) of said reservoir, and returns to its initial position by fitting into said recess (16), and thus said reservoir is removably secured (or maintained) inside said housing of the appliance (11).

Also preferably, said recess(es) (16) of said reservoir (10) have exactly complementary shapes of said protrusion (17) of said dispensing appliance (11). Indeed, it is preferred that all the contours of the reservoir fit all the contours of the recess of the dispensing means, thus providing enhanced maintain of said reservoir. However, the shape of the reservoir may be such that it differs from the shape of the dispensing means' housing but still fits therein, such that a fluid connection between the two is established. However, it will be easily understood that the risk of leakage is enhanced in case all the contours of the reservoir are not properly maintained by the contours of the dispensing means.

As shown in FIGS. 1A to 1C, the locking mechanism (25) between the reservoir (10) and the dispensing appliance (11) is releasable. To this effect, the at least one protrusion (17) of the appliance (i.e. preferably a slideable ring (17) as herebefore described) is movable, such that it can be engaged/disengaged from the corresponding recess(es) (16) of the reservoir. This is preferably achieved by providing a locking mechanism (25) which is of the push-button type, press-button type, or any other suitable means for releasing the at least one protrusion from the at least one recess. More preferably, the locking mechanism (25) is a push-button releasable locking mechanism (25). It comprises a movable protrusion (17) which is mounted with a spring means (27), for example an helicoidal metallic spring (27), or a plastic or metallic spring blade. The protrusion (17) is connected to a push button, which is accessible to the consumer from the outside of the device's housing. When the reservoir (10) is in place and locked into the housing, the user can exert a push on the button, to release the protrusion (17) from the reservoir's recess, and remove said reservoir (10) from the device (1).

The protrusion of the appliance, i.e. preferably a spring-loaded slideable ring (17), can have any shape, as long as it is able to cooperate with the shape of the recess. For example, in can be a simple pin, but it can also be a hook, or it can even have more complex shape, as door keys have.

Reservoir

Reservoir pierceable means:

After removing the reservoir (10) from the appliance, the user might be in a situation where a certain amount of product remains in said reservoir (10), for example in case the user would like to temporarily use the dispensing appliance (11) for dispensing another type of product. In this case, the remaining product may well leak through the open pierceable means (14) of the reservoir (10), which is clearly undesirable to the consumer. Also, during usage of the device (1), it is essential that the fitment between the reservoir (10) and the dispensing appliance (11) is leak-tight, so as to prevent that liquid can contact the interior of the appliance. Indeed in some cases, said appliance is electrical, so any leakage of liquid inside the electrical circuits may lead to damage to the appliance, or even to injuries to the user, which is of course clearly undesirable.

In the following description, for clarity purposes, the sole embodiment wherein the pierceable means (14) of the reservoir (10) is a pierceable membrane (14) will be discussed. However, this should not limit the scope of the present invention, since the pierceable means (14) may alternatively be achieved in other ways. For example, the pierceable means (14) can be one portion of the reservoir's wall which is for example molded integrally with said reservoir (10) by a co-injection molding process, also it can be a portion which is added to the walls of the reservoir (10) by means of gluing or welding process.

After the reservoir (10) has been in place within the appliance for one month or more, it has been shown that most known membranes stay in a deformed configuration, more particularly, they keep the form of the needle (15) that was piercing through, in the shape of one or more holes, which of course renders the container subject to leakage. This phenomenon is usually called setting-up and appears within a few weeks after the needle (15) has been inserted. Surprisingly, it has been found that a pierceable membrane (14) as described hereafter provides excellent leak-tightness once it is pierced by the needles (15) of the appliance. Moreover, it shows the very good advantage that, once the reservoir (10) is removed from said appliance, said membrane (14) recloses in such a way that setting-up, and thus leakage is prevented, even after the reservoir (10) has been in place within the appliance for one month or more. Such a membrane is preferred in the context of a fitment according to the present invention.

This is achieved by making a membrane (14) which does not take a set after having been pierced. It has been found that this effect can be achieved by making the membrane (14) out of at least one layer of one or more material(s), including at least one layer of an elastomeric material. Preferably, the membrane (14) is made out of at least one layer elastomeric material that will provide good reclosability properties, that is to say, whenever the membrane (14) is pierced and even though the piercing means (15) stays into the membrane (14) over a long period of time, the elastomeric layer will prevent the membrane (14) from taking a set, and it will ensure that once the piercing means (15)—for example the needle (15)—is removed from the membrane (14), said membrane (14) will retrieve its initial—closed—shape, so as to prevent leakage. Additional layers made out of different materials may be used, for example one layer of a material that is chemically resistant to the reservoir (10) contents may constitute the inner layer of the membrane (14). Alternatively, materials such as metal, plastic, aluminum, alloys, paper or cardboard, Teflon, or any other suitable material may be added to the layer of elastomeric material, in any combination of layers.

In a first and preferred embodiment, the membrane (14) is made out of one layer of silicon, which provides excellent material memory, as well as good chemical resistance to the reservoir's contents.

In a second embodiment, the membrane (14) is made out of a combination of silicon and an inert PET. Silicon provides excellent memory to the materials, so that the membrane (14) will close back after having been pierced, whereas inert PET provides chemical resistance to the product contained inside the reservoir (10). In a most preferred embodiment of the present invention, the elastomeric membrane (14) is made out of two layers: one inner layer out of inert PET, which comes in contact to the inside of the reservoir (10) and is especially meant to chemically resist to its contents, and an outer layer which is on contact with the atmosphere, and is made out of a silicon.

In both of the preceding embodiments, the thickness of the membrane (14) is an important parameter, and has an influence on the memory of the material. Preferably, the membrane (14) has a thickness less than 1 cm, more preferably, less then 6 mm, and even more preferably less than 4 mm, all thicknesses being measured in the portion of the membrane (14) which is comprised in the middle portion of said membrane (14), i.e. in the region which will be pierced (see FIG. 2).

The membrane (14) can have any suitable shape, but preferably it has a circular shape, with an overall diameter preferably comprised within the range of 0.5 to 5 cm, more preferably comprised within the range of 0.7 to 2 cm, and even more preferably comprised within the range of 0.9 to 1.1 cm. It has been shown that a ratio of 3.6 mm thickness in the middle pierceable portion, for 1 cm overall diameter, provides good memory properties for a one layer silicon membrane (14), and prevents setting-up in a very good manner.

As previously described, the pierceable membrane (14) may be part of the appliance, but preferably, it is part of the reservoir (10) or the cap (28) closing said reservoir (10), and in the most preferred embodiment of the present invention, said pierceable membrane (14) is attached to the top portion of the cap (28). It must be attached in such a way that it is very difficult to remove it without using a tool. It can be mechanically inserted by means of ribs that fit into grooves, as shown in FIG. 2, or it can be attached by some other means, such as for example heat sealing, gluing, welding. It can also be co-injected in the same injection mold, together with the cap itself which provides the advantage of being cheap to produce. In case it is made out of silicon or similar elastomeric material, the membrane (14) can also be cast-molded, and then UV-cured.

The cap can have any suitable shape, for example it can have a truncated profile. It can be screwed onto the neck (19) of the reservoir (10), for example by means of one or several screw threads, but it can also be secured by any other suitable means, such as bayonet fitment means, clipping means, or similar. However, a device (1) using a fitment according to the present invention is even better achieved if the reservoir (10) is equipped with a pierceable cap with silicon membrane (14), as previously described, wherein said cap can be secured onto the neck (19) of said reservoir (10), but cannot be removed. In such an embodiment, the reservoir (10) is difficult to open by children, because if the adult user needs to remove the reservoir (10) from the appliance when said reservoir (10) is not yet empty, the product contained inside said reservoir (10) cannot leak because the pierceable membrane (14) recloses upon removal of the reservoir (10), and the cap cannot even be removed without using a tool and using a substantial amount of lever force. This means that there is low chance for a kid to get in contact with the composition contained inside. Such non-removable fitment can be achieved by any suitable means, such as for example screw threads with non return triangular lugs, which allow screwing of the cap, but whereby unscrewing is prevented.

Releasing means on reservoir:

As already described above, the dispensing appliance (11) comprises a protecting plate (20) which prevents access to the appliance piercing means (15) unless said protecting plate (20) is released by inserting the reservoir (10) thereinto. Therefore, it is an essential feature of the reservoir of the present invention that it comprises a releasing means (30) to release said protecting plate (20) when said reservoir (10) is inserted into said appliance (11), thus giving access to the needles. In a preferred embodiment of the invention, the releasing means (30) of the reservoir comprises a tapered end portion (30), preferably top end portion of said reservoir that is capable of engaging and sliding the actuation trigger, i.e. slideable ring of the appliance.

Reservoir securing means:

It has been shown that devices which comprise the assembling of a dispensing appliance and a reservoir, and which are subject to movements in all directions during use, are subject to leakage between said reservoir (10) and said dispensing appliance (11). This leads to spilling of product onto unexpected areas, which is clearly messy, and can even be dangerous, depending on the nature of the product which is dispensed.

As shown in FIGS. 1A to 1C and 2A to 2F, the reservoir (10) optionally comprises a securing means, preferably a recess (16) which is preferably located near the top end of the reservoir, for example on the neck (19), or directly on the cap (28), or alternatively, the recess is constituted by the difference of external diameter between the neck (19) of the bottle and the cap (28) itself. In the latter case, if the external diameter of the cap (28) is greater than the external diameter of the reservoir's neck (19), a recess is created at the time the cap is secured onto said neck. The dispensing appliance (11) comprises one protrusion, i.e. preferably a slideable ring, which is positioned such that when the at least one needle (15) of said dispensing appliance (11) has pierced the rubber septum (14) of the reservoir's cap (28), and a fluid communication is established between the two, the protrusion (17) exactly fits into the recess (16). This construction is important since the reservoir is preferably manufactured with a blow-molding process. Thus, tolerances in the reservoir are not as precise as the tolerance of a piece which is injection molded. There is a need for high accuracy in the mating of the locking fitment system to prevent movement of the reservoir (10) within the dispensing means housing. This is highly critical in the region of the connection between the needle (15) and the elastomeric membrane (14), where the risk of leakage is the highest. It was found that by minimizing the distance between the locking mechanism (25) and the membrane/needle fitment, the reservoir (10) is better held in place into the housing, in the region of the membrane/needle fitment.

What is claimed is:

1. A floor cleaning apparatus comprising:

a dispensing appliance comprising a handle and a nozzle;

a reservoir filled with a cleaning solution, said reservoir comprising an opening covered with a pierceable member;

a fitment comprising a piercing member for transferring a cleaning solution from said reservoir to said nozzle, a venting member for venting said reservoir and a spring loaded movable protecting member for preventing access to said piercing member and said venting member when said reservoir is not connected to said fitment, wherein said protecting member covers said piercing member and said venting member when said piercing member and said venting member are not in use, wherein said spring loaded movable protecting member is movable under manual force applied directly or indirectly thereto and wherein said cleaning solution flows within said piercing member when said reservoir is attached to said fitment and when said piercing member pierces said pierceable member; and a flexible tube for establishing fluid communication between said piercing member and said nozzle.

2. The cleaning apparatus of claim 1 wherein said reservoir is substantially rigid.

3. The cleaning apparatus of claim 1 wherein said appliance further comprises a housing for retaining said reservoir.

4. The cleaning apparatus of claim 1 wherein said cleaning solution flows by gravity within said piercing member when said piercing member pierces said pierceable member and said reservoir is inverted.

5. The cleaning apparatus of claim 1 wherein said pierceable member is a membrane.

6. The cleaning apparatus of claim 1 wherein said piercing member is hollow and has an outside diameter comprised between 0.7 mm and 7 mm.

7. The cleaning apparatus of claim 1 wherein said piercing member is hollow and has an inside diameter comprised between 0.5 mm and 2 mm.

8. The cleaning apparatus of claim 1 wherein said piercing member is hollow and comprises a hole on its lateral side.

* * * * *